United States Patent [19]

Makita

[11] Patent Number: 4,717,812

[45] Date of Patent: Jan. 5, 1988

[54] PLANAR HEAT GENERATOR

[75] Inventor: Hajime Makita, Tokyo, Japan

[73] Assignee: Shigma, Inc., Elk Grove Village, Ill.

[21] Appl. No.: 865,030

[22] Filed: May 20, 1986

[30] Foreign Application Priority Data

May 21, 1985 [JP] Japan ..... 60-75568

[51] Int. Cl.[4] ..... H05B 3/34; H01C 3/06

[52] U.S. Cl. ..... 219/528; 219/345; 219/544; 219/548; 219/549; 338/214; 338/314

[58] Field of Search ..... 219/345, 528, 544, 548, 219/549; 338/214, 314

[56] References Cited

U.S. PATENT DOCUMENTS 3,423,574 1/1969 Shomphe et al. ..... 219/528

4,358,668 1/1982 McMullan et al. ..... 219/528

*Primary Examiner*—E. A. Goldberg

*Assistant Examiner*—Gerald E. Preston

*Attorney, Agent, or Firm*—Wenderoth, Lind & Ponack

[57] ABSTRACT

A planar heat generator comprises a heating element of metallic foil; a first pair of sheets made of a plastic material which are bonded to each other so that the heating element is interposed therebetween; a second pair of sheets made of a plastic material which are bonded to the outer surfaces of the first pair of sheets, respectively; and a pair of protective covers which are made of a plastic material having a melting point at least approximate to that of the material of the second pair of sheets. The protective covers are larger in area than the second pair of sheets and are bonded by fusion not only to the outer surfaces of the second pair of sheets, respectively, but also to each other at peripheral areas which extend beyond the peripheral margins of the second pair of sheets.

2 Claims, 1 Drawing Figure

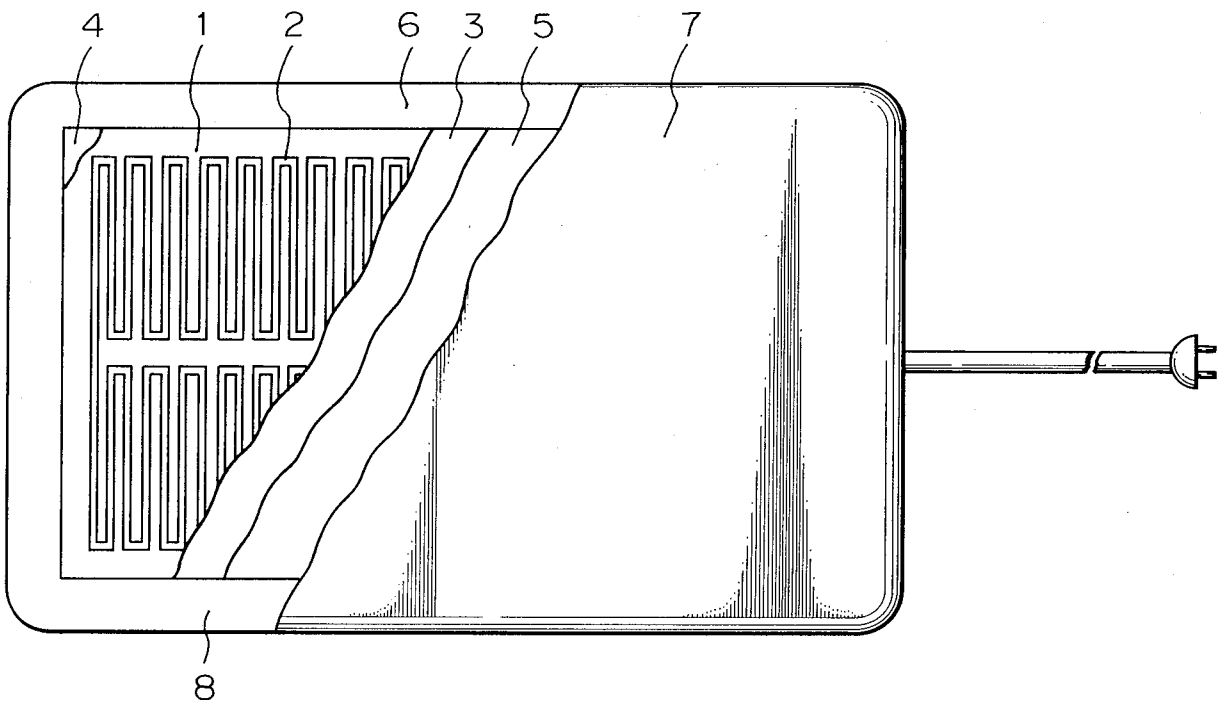
7
5
3
6
2
1
4
8

PLANAR HEAT GENERATOR

FIELD OF THE INVENTION

The present invention relates to a planar heat generator with protective covers on both outer surfaces.

BACKGROUND OF THE INVENTION

A typical planar heating assembly is composed of a heating element of metallic foil and a pair of sheets made of plastic material which are equal to each other in shape and size. In assembly, the heating element is provided on one surface of one sheet and then the other sheet is bonded to that surface so that the heating element is clamped between the sheets.

In many cases, the heating assembly is required to be wholly enclosed by protective means so as to be airtight and electrically insulated. Typically, such protective means consists of a pair of protective covers made of insulating sheet material which are substantially larger in size than the heating assembly to be enclosed by them. The protective covers are positioned on both surfaces of the heating assembly in such a manner that peripheral areas of the respective protective covers extend beyond a margin of the heating assembly, and then the protective covers are bonded together by fusion along their opposed peripheral areas to form a planar heat generator which is airtight and electrically insulated.

If any air is trapped between the heating assembly and the protective covers, heat from the heating element when in use would cause an excessive increase in temperature in the local areas where air bubbles are contained. To avoid this situation, it is necessary to ensure a state of close adherence between the protective covers and both surfaces of the heating assembly. However, the plastic sheets composing the heating assembly are usually made of polyester, while the protective covers are usually made of polyvinyl chloride, and since these respective plastic materials differ in melting point from each other, great difficulty has been encountered in providing for perfect adherence between them by fusion.

Some efforts have been made toward solving the abovementioned problem. One solution is disclosed in Japanese Utility Model Public Disclosure No. 58-152794 in which the protective covers are directly bonded to each other by fusion through plural holes which are bored through the heating assembly at portions other than those where the heating element is located.

However, the planar heat generator disclosed in the above Japanese U.M. Public Disclosure has been found to be unacceptable because of the following disadvantages. First, the outer surfaces of the planar heat generator thus obtained are not smooth and have recesses thereon because of the existence of the holes under the protective covers. This not only prevents successful application of embossing or screen printing thereon but also impairs the appearance of the finished product. In addition, some difficulties are involved in labelling thereon. Secondly, a serious problem is caused in the fusion process. It is necessary in a fusion process to apply uniform pressure on the protective covers in order to expel the air between the covers and the heating assembly. However, some holes are in fact less firmly pressed than the rest and, accordingly, air bubbles are left in these holes. In a case where heat is supplied during the thermal adhesion of metallic foil shielding layers on both surfaces of the heat generator at a subsequent stage, these air bubbles are expanded by the heat. Even after cooling, the resulting expansion is not eliminated and undesirable irregularity remains on each shielding layer surface. This irregularity also prevents successful application of the above-mentioned embossing, screen printing or labelling and impairs the appearance of the finished product.

SUMMARY OF THE INVENTION

An object of the present invention is to provide a planar heat generator which is free from surface irregularities so as to be suitable for embossing, screen printing or labelling.

Another object of the invention is to provide a planar heat generator which is free from the problem of air being trapped therein.

Still another object of the invention is to provide a planar heat generator which can be manufactured in a very easy manner.

To accomplish the above and other objects, the planar heat generator according to the present invention comprises: a heating element of metallic foil; a first pair of sheets made of a plastic material which are equal in shape and size to each other, one of the sheets being provided with the heating element on one surface thereof and being bonded to the other sheet so that the heating element is interposed between the two sheets; a second pair of sheets made of a plastic material which are equal in shape and size to the first pair of sheets and which are bonded to the outer surfaces of the first pair of sheets, respectively; and a pair of protective covers which are equal in shape and size to each other and which are made of a plastic material having a melting point at least approximate to that of the material of the second pair of sheets, the protective covers being larger in area than the second pair of sheets and being bonded by fusion not only to the outer surfaces of the second pair of sheets, respectively, but also to each other at peripheral areas which extend beyond the peripheral margins of the second pair of sheets.

BRIEF DESCRIPTION OF THE DRAWING

The drawing is a schematic, partially cutaway plan view of one preferred embodiment of the planar heat generator constructed in accordance with the present invention.

DESCRIPTION OF THE PREFERRED EMBODIMENTS

A heating element 2 made of thin metallic foil such as aluminium foil is formed on one side of a sheet 1. The metallic foil heating element 2 may be produced by known methods such as etching. A sheet 3 which is equal to the sheet 1 in shape and size is overlaid face to face on the sheet 1 so that the heating element 2 is clamped between the sheets 1 and 3. The sheets 1 and 3 may preferably be made of polyester having a characteristic of high heat resistance. Thus, the sheets 1 and 3 are bonded to each other, with the heating element interposed therebetween, by a suitable known method such as use of proper adhesives, to form a heating assembly.

A second pair of sheets 4 and 5, which are substantially equal in shape and size to the first pair of sheets 1 and 3 and which may preferably be made of polyvinyl chloride providing electrical insulation, are bonded to both outer surfaces of the heating assembly, respectively, to form a layered composite. The adhesion of the sheets 4 and 5 may preferably be conducted by thermal compression after applying proper adhesives to the surfaces to be bonded.

In practical fabrication of the above layered composites at the factory, a continuous process may be employed to achieve mass production of such layered composites. Each of the layered composites may be obtained by cutting from a continuous length of web composed of an elongated inner pair of polyester layers bonded to each other and clamping therebetween a plurality of heating elements 2 which are arranged along the length of the web and an elongated outer pair of polyvinyl chloride layers overlaying and bonded to the polyester layers. The layered composites thus obtained are left unsealed at their cut ends and require finishing at a subsequent stage before becoming completed products.

A third pair of sheets comprising protective covers 6 and 7 are substantially equal in shape and size to each other and are larger in size than the second pair of sheets 4 and 5. The protective covers 6 and 7 are made of a plastic material having the same or approximately the same melting point as that of the material of the sheets 4 and 5 for bonding by fusion therebetween. In a most preferred embodiment, the protective covers 6 and 7 and the second pair of sheets 4 and 5 are made of polyvinyl chloride. The layered composite composed of the heating element 2 and the sheets 1, 3, 4 and 5 is positioned centrally between the protective covers 6 and 7, and the covers 6 and 7 are then pressed on the respective outer surfaces of the layered composite under a high temperature which is sufficient for fusion processing. Thus, the protective covers 6 and 7 are bonded by fusion in a closely airtight condition not only to the surfaces of the sheets 4, 5 but also to each other at peripheral areas 8 of the protective covers 6 and 7 which extend beyond a margin of the layered composite. Since both surfaces of the layered composite are smooth, air is completely expelled by heat and pressure. Accordingly, the planar heat generator thus obtained does not include therein any air bubbles. In addition, since the peripheries of the protective covers 6 and 7 are bonded to each other by fusion, no air can enter the planar heat generator during use.

If desired, embossing, printing, labelling or shielding may be applied on the outer surfaces of the planar heat generator.

The protective covers 6 and 7 need not be two separate sheets; a continuous one-piece sheet may be used instead. In use, the one-piece sheet is folded for enclosing therein the layered composite.

The sheets 1 and 3 may be made of suitable material other than polyester. In addition, the sheets 4 and 5 and the protective covers 6 and 7 may be made of suitable material other than polyvinyl chloride.

Although the planar heat generator of the present invention has been described with reference to certain specific embodiments thereof, other modifications are possible without departing from the spirit of this invention.

What is claimed is:

1. A planar heat generator comprising:

a heating element of metallic foil;

a first pair of sheets made of a plastic material having a characteristic of high heat resistance which are equal in shape and size to each other, one of the sheets being provided with said heating element on one surface thereof and being bonded to the other sheet so that the heating element is interposed between the two sheets;

a second pair of sheets made of a plastic material having a melting point lower than that of the material of the first pair of sheets, which are equal in shape and size to the first pair of sheets and which are bonded to the outer surfaces of the first pair of sheets, respectively; and a pair of protective covers which are equal in shape and size to each other and which are made of a plastic material having a melting point at least approximate to that of the material of the second pair of sheets, the protective covers being larger in area than the second pair of sheets and being bonded by fusion in an airtight condition not only to the outer surfaces of the second pair of sheets, respectively, but also to each other at peripheral areas which extend beyond the peripheral margins of the second pair of sheets.

2. The planar heat generator of claim 1, wherein the first pair of sheets are made of polyester, and the second pair of sheets and the protective covers are made of polyvinyl chloride.

* * * * *